United States Patent [19]

Nakamura et al.

[11] 4,379,820

[45] Apr. 12, 1983

[54] ELECTROPHOTOGRAPHIC PHOTOCONDUCTOR OF HALOGEN-DOPED SE-TE ALLOY LAYERS

[75] Inventors: Hitoshi Nakamura; Hideyo Nishizima; Hideaki Ema; Makoto Harigaya; Satoshi Otomura, all of Numazu, Japan

[73] Assignee: Ricoh Company, Ltd., Tokyo, Japan

[21] Appl. No.: 255,168

[22] Filed: Apr. 17, 1981

[30] Foreign Application Priority Data

Apr. 22, 1980 [JP] Japan ..... 55-52381

[51] Int. Cl.[3] ..... G03G 5/082

[52] U.S. Cl. ..... 430/58; 430/85; 430/95

[58] Field of Search ..... 430/57, 58, 85, 86, 430/128, 95

[56] References Cited

U.S. PATENT DOCUMENTS

| | | | |
|---|---|---|---|
| 4,286,035 | 8/1981 | Nishizima et al. | 430/85 |
| 4,296,191 | 10/1981 | Jacobson et al. | 430/85 |
| 4,297,424 | 10/1981 | Hewitt | 430/58 |

*Primary Examiner*—John E. Kittle
*Assistant Examiner*—John L. Goodrow
*Attorney, Agent, or Firm*—Oblon, Fisher, Spivak, McClelland & Maier

[57] ABSTRACT

A layered electrophotographic photoconductor comprising an electrically conductive base; a charge transporting layer, formed on the electrically conductive base, which charge transporting layer comprises a selenium-tellurium alloy, doped with halogen; and a charge generating layer, formed on the charge transporting layer, which charge generating layer comprises a selenium-tellurium-arsenic alloy, doped with halogen.

4 Claims, 5 Drawing Figures

ELECTROPHOTOGRAPHIC PHOTOCONDUCTOR OF HALOGEN-DOPED SE-TE ALLOY LAYERS

BACKGROUND OF THE INVENTION

The present invention relates to a layered electrophotographic photoconductor and more particularly to a layered electrophotographic photoconductor comprising an electrically conductive base, a charge transporting selenium-tellurium-halogen alloy layer, and a selenium-tellurium-arsenic-halogen alloy layer.

Conventionally, a variety of selenium photoconductors have been proposed for use in electrophotography. A conventional selenium photoconductor comprises an electrically conductive base and a photoconductive layer consisting of amorphous selenium. This selenium photoconductor exhibits good electric charge reception and charge retention properties in the dark, in comparison with other conventional photoconductors. In particular, since it responds sharply to light waves in a comparatively short wavelength range of shorter than 600 nm, it can be used for various purposes.

However, when the selenium photoconductor is continuously used in a copying process for an extended period of time, with charging and exposure thereof repeated a number of times, light fatigue and charging fatigue are caused. The light fatigue lowers the image density of the image produced by the selenium photoconductor, while the charging fatigue causes toner deposition on the background of the copy image.

As mentioned previously, the selenium photoconductor exhibits its spectral sensitivity in the comparatively short wavelength range of shorter than 600 nm. However, it does not exhibit any substantial spectral sensitivity in the wavelength range of longer than 600 nm. Therefore, it is desired that the spectral sensitivity range of the selenium photoconductor be expanded to a longer wavelength range beyond 600 nm.

Furthermore, in the conventional selenium photoconductor, the amorphous selenium in the photoconductive layer is apt to be crystallized while in use and once such crystallization of selenium takes place, the photoconductor cannot be used any longer for electrophotography. In this sense, concerning the conventional selenium photoconductor, prevention of such crystallization is desired. Moreover, the conventional selenium photoconductor is poor in resistance to physical wear and tear.

In order to improve the spectral sensitivity of the selenium photoconductor, a method of adding tellurium to the selenium photoconductor has been proposed. This method works for sensitizing the selenium photoconductor with the spectral sensitivity thereof expanded to some extent. However, that method has side effects of significantly increasing the light fatigue of the selenium photoconductor while in use, and lowering the charge reception and charge retention capabilities as the content of tellurium in the selenium layer of the photoconductor increases.

Furthermore, the selenium-tellurium photoconductor has a shortcoming in that it tends to be fatigued by repeated charging. In order to improve on the charging fatigue shortcoming of the selenium-tellurium photoconductor, a method of doping the selenium-tellurium alloy with halogen has also been proposed. That method, however, has the additional shortcoming of degrading the charge reception and charge retention capabilities of the selenium-tellurium photoconductor.

SUMMARY OF THE INVENTION

It is therefore an object of the present invention to provide a selenium-tellurium electrophotographic photoconductor with its spectral sensitivity range expanded to a wavelength range longer than 600 nm, and with its light fatigue and charging fatigue extremely reduced in comparison with those of the conventional selenium-tellurium electrophotographic photoconductors.

Another object of the present invention is to provide a selenium-tellurium electrophotographic photoconductor of the above-described type, which is excellent in wear resistance and capable of avoiding crystallization of selenium in the photoconductor.

In the present invention, the above-mentioned objects have been successfully achieved by a layered electrophotographic photoconductor comprising an electrically conductive base; a charge transporting layer formed on the electrically conductive base, the charge transporting layer with a thickness in the range of 45 to 55 μm, comprising a selenium-tellurium alloy with a concentration of tellurium in the range of 1 to 10 weight percent, doped with halogen with a concentration in the range of 10 to 500 ppm; and a charge generating layer formed on the charge transporting layer, with a thickness in the range of 3 to 10 μm, comprising a selenium-tellurium-arsenic alloy with a concentration of tellurium in the range of 6 to 10 weight percent and with a concentration of arsenic in the range of 0.5 to 10 weight percent with respect to the selenium-tellurium alloy, doped with halogen with a concentration of 10 to 500 ppm.

DETAILED DESCRIPTION OF THE PREFERRED EMBODIMENTS

Figure 1:
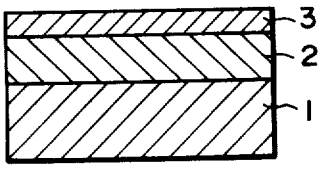
FIG. 1 is schematic sectional view of a layered photoconductor according to the present invention.

Referring to FIG. 1, there is schematically shown a cross-sectional view of a layered electrophotographic photoconductor according to the present invention. Reference numeral 1 designates an electrically conductive base; reference numeral 2, a charge transporting layer; and reference numeral 3, a charge generating layer.

The charge transporting layer, with a thickness ranging from 45 μm to 55 μm, is formed on the electrically conductive base 1, which charge transporting layer 2 comprises a selenium-tellurium alloy, the concentration of tellurium ranging from 1 to 10 weight percent, doped with halogen with a concentration of 10 to 500 ppm.

The charge generating layer 3, with a thickness ranging from 3 μm to 10 μm, is formed on the charge transporting layer 2, which charge generating layer 3 comprises a selenium-tellurium-arsenic alloy, the concentration of tellurium ranging from 6 to 10 weight percent of the total of selenium and tellurium and the concentration of arsenic ranging from 0.5 to 10 weight percent with respect to the selenium-tellurium alloy, which selenium-tellurium-arsenic alloy is doped with halogen with a concentration ranging from 10 to 500 ppm.

When light is projected upon the charge generating layer 3, charge carriers are generated in the charge generating layer 3. The thus generated charge carriers are transported to the electrically conductive base 1 through the charge transporting layer 2.

In the charge transporting layer 2, tellurium serves to facilitate injection of charges generated in the charge generating layer 3 into the charge transporting layer 2, while halogen serves to decrease the density of the dangling bonds between the selenium atoms and tellurium atoms in the charge transporting layer 2, thereby increasing the charge carrier transporting efficiency of the charge transporting layer 2.

As mentioned previously, in the charge transporting layer 2, the content of tellurium ranges from 1 to 10 weight percent of the total amount of selenium and tellurium in the selenium-tellurium-halogen alloy. When the content of tellurium is less than 1 weight percent, charge carrier injection from the charge carrier generating layer 3 into the charge transporting layer 2 is not effected, while when the content of tellurium exceeds 10 weight percent, the density of the dangling bonds between the selenium and tellurium atoms increases, so that charge carrier transportation is hindered.

As halogen, chlorine or iodine can be employed. The content of halogen ranges from 10 ppm to 500 ppm with respect to the total amount of selenium and tellurium in the charge transporting layer 2. When the content of halogen is less than 10 ppm, the density of the dangling bonds between the selenium and tellurium atoms cannot be decreased sufficiently, while when the content of halogen exceeds 500 ppm, the charge retention property of the photoconductor is significantly degraded.

The thickness of the charge carrier transporting layer 2 is in the range of 45 μm to 55 μm. When the thickness of the charge carrier transporting layer is less than 45 μm, the charge reception capability of the photoconductor is significantly degraded and accordingly the photosensitivity of the photoconductor is also degraded, while when the thickness of the charge carrier transporting layer exceeds 55 μm, the charge reception property does not increase with the increase in the thickness thereof and therefore it is unnecessary to increase the thickness beyond 55 μm.

As mentioned previously, the charge generating layer 3, which comprises a selenium-tellurium-arsenic-halogen alloy, generates charge carriers when exposed to light.

In the charge generating layer 3, tellurium, arsenic and halogen are for improving on the shortcomings of the conventional selenium photoconductor. In particular, tellurium serves to sensitize the charge generating layer 3 by expanding its spectral sensitivity to a wavelength range beyond 600 nm. As mentioned previously, the concentration of tellurium ranges from 6 to 10 weight percent of the total of selenium and tellurium. When the concentration of tellurium is less than 6 weight percent, the sensitization of the charge generating layer 3 becomes insufficient for practical use and the conjunction of the charge transporting layer 2 and the charge generating layer 3 becomes incomplete, so that the injection of charges from the charge generating layer 3 into the charge transporting layer 2 is hindered. When the concentration of tellurium exceeds 10 weight percent, the charge retention property of the photoconductor in the dark is degraded and light fatigue tends to develop considerably.

Figure 2:
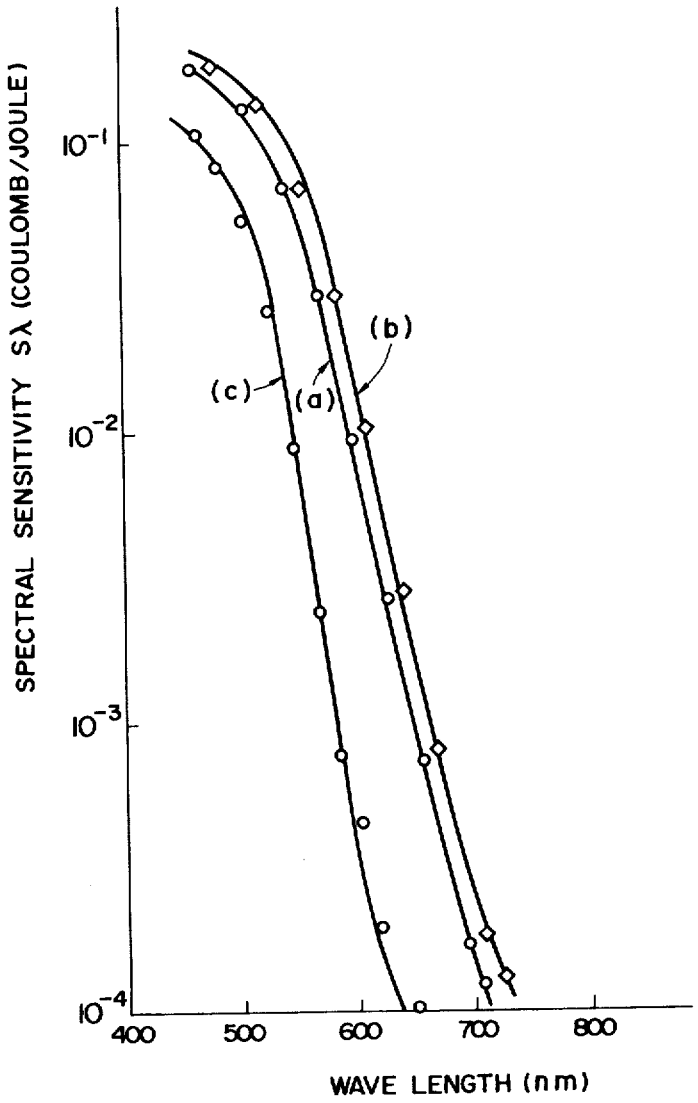
FIG. 2 is a graph showing the spectral sensitivities of two embodiments of a layered photoconductor according to the present invention and the spectral sensitivity of a conventional selenium photoconductor.

The sensitizing effect of arsenic is clearly shown in FIG. 2. In the figure, there are shown the spectral sensitivities of first and second embodiments of a layered photoconductor according to the present invention by curve (a) and curve (b) respectively, and the spectral sensitivity of a conventional selenium photoconductor by curve (c).

This conventional photoconductor is of a single layer type, which comprises an electrically conductive base made of aluminum with a thickness of 0.5 mm, and a photoconductive layer with a thickness of about 60 μm, consisting of a selenium-tellurium-chlorine alloy, the concentration of tellurium being 8 weight percent of the total selenium and tellurium and the concentration of chlorine being equal to 60 ppm of the total amount of selenium and tellurium.

The first embodiment of a selenium photoconductor according to the present invention is of a double layered type, which comprises an electrically conductive base made of aluminum with a thickness of 0.5 mm, a charge transporting layer with a thickness of 50 μm, comprising a selenium-tellurium-iodine alloy, the concentration of tellurium being 6 weight percent of the total of selenium and tellurium, and the concentration of iodine being equal to 500 ppm of the total of selenium and tellurium; and a charge generating layer with a thickness of 5 μm, formed on the charge transporting layer, comprising a selenium-tellurium-arsenic-iodine alloy, the concentration of tellurium being 6 weight percent of the total of selenium and tellurium, and the concentration of arsenic being equal to 5 weight percent of the total of selenium and tellurium, and the concentration of iodine being equal to 500 ppm of the total of selenium and tellurium. Preparation of the first embodiment will be described later in Example 1.

The second embodiment of a layered photoconductor according to the present invention comprises an electrically conductive base made of aluminum with a thickness of 0.5 mm; a charge transporting layer with a thickness of 50 μm, comprising a selenium-tellurium-chlorine alloy in which the concentration of tellurium is 8 weight percent of the total amount of selenium and tellurium, and the concentration of chlorine is equal to 50 ppm by weight of the total amount of selenium and tellurium; and charge generating layer with a thickness of 5 μm, formed on the charge transporting layer, comprising a selenium-tellurium-arsenic-chlorine alloy, in which the concentration of tellurium is 6 weight percent of the total amount of selenium and tellurium, and the concentration of arsenic is equal to 8 weight percent of the total amount of selenium and tellurium, and the concentration of chlorine is equal to 50 ppm by weight of the total amount of selenium and tellurium. Preparation of the second embodiment will be described in Example 2.

As can be seen from FIG. 2, the spectral sensitivities of the photoconductors according to the present invention are shifted toward longer wavelengths by the addition of arsenic in comparison with the spectral sensitivity of the conventional selenium photoconductor.

Moreover, arsenic contained in the charge generating layers of the photoconductors according to the present invention serves to improve the wear resistance of the photoconductors and to prevent crystallization of amorphous selenium in the photoconductors. The appropriate concentration of arsenic in the charge generating layer ranges from 0.5 to 10 weight percent with respect to the total of selenium and tellurium. When the concentration of arsenic is less than 0.5 weight percent, the above-mentioned effects of improving the wear resistance of the photoconductor and of preventing crystallization of armorphous selenium cannot be attained. When the concentration of arsenic exceeds 10 weight percent, light fatigue of the photoconductor takes place so easily that the photoconductor cannot be used a number of times in repetition.

By the addition of arsenic, the hardness of the photoconductor according to the present invention is significantly increased. Specifically, the hardness of the surface of the conventional selenium photoconductor, which does not contain arsenic, is 40 to 50 in terms of Vickers' hardness under application of a load of 25 g.

In contrast, the hardness of the surfaces of the photoconductors according to the present invention, which contain arsenic, ranges from 70 to 90 in terms of Vickers' hardness under the same condition as mentioned above. Thus, the wear resistance of the photoconductors according to the present invention is significantly improved by the addition of arsenic in comparison with that of the conventional photoconductor.

Furthermore, by the addition of arsenic, crystallization of amorphous selenium in the photoconductors can also be prevented.

Figure 3:
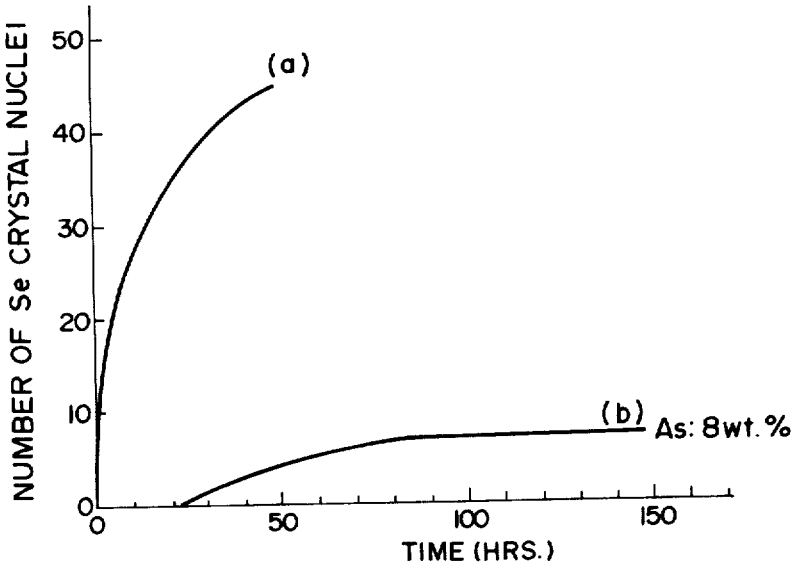
FIG. 3 is a graph showing the selenium crystal nucleus formation rate of an embodiment of a layered photoconductor according to the present invention and the selenium crystal nucleus formation rate of the conventional selenium photoconductor when they were allowed to stand at 80° C.

Referring to FIG. 3, there are shown the crystallization rates of amorphous selenium in the conventional photoconductor and in the second embodiment of a layered photoconductor according to the present invention. In the figure, the number of selenium crystal nuclei grown per unit area of each photoconductor in the atmosphere at 80° C. is plotted with time, with the number of selenium crystal nuclei as ordinate and time as abscissa. In the figure, curve (b) is for the second embodiment, while curve (c) is for the conventional photoconductor. Although the crystallization of amorphous selenium depends upon the ambient temperature and the duration of the test conditions at that temperature, the reason for setting the ambient temperature at as high as 80° C. in these tests is to see how arsenic works for hindering the crystallization of amorphous selenium in a short period of time. According to our further tests, the results of the tests at 80° C. correspond to the results of the crystallization tests at lower temperatures for a prolonged period of time.

As can be seen from the results shown in FIG. 3, in the case of the conventional selenium photoconductor which does not contain arsenic, the number of selenium crystal nuclei increased rapidly with time as shown by curve (c). Within 50 hours after starting the test, the number of selenium crystal nuclei amounted to 45.

In contrast, in the case of the second embodiment of a layered electrophotographic photoconductor according to the present invention, which contains 8 weight percent of arsenic with respect to the amount of selenium and tellurium, no selenium crystal nuclei were formed for about 20 hours after starting the test. At about 20 hours, selenium crystal nuclei began to be formed and, thereafter, the number of selenium crystal nuclei gradually increased, but in 50 hours, the number of selenium crystal nuclei formed was only 4. In about 85 hours, the number of selenium crystal nuclei became maximum, but was still only 7. Thereafter, the number of selenium crystal nuclei remained unchanged till at least 150 hours at 80° C. after starting the test.

The growth rate of a selenium crystal nucleus in the conventional selenium photoconductor was then compared with the growth rate of a selenium crystal nucleus in the second embodiment of a layered electrophotographic photoconductor according to the present invention by measuring the radius of each selenium nucleus with time. The data was plotted in FIG. 4, with the diameter of each selenium crystal nuclei as ordinate and time as abscissa. As can be seen from FIG. 4, the radius of a selenium crystal nuclei in the conventional selenium photoconductor (refer to curve (c)) increased up to 20 μm in 50 hours, while the radius of a selenium crystal nuclei in the second embodiment of a layered electrophotographic photoconductor according to the present invention (refer to curve (b)) increased to less than 2.5 μm in the same time, and in 150 hours after starting the test at 80° C. the radius was only 8.5 μm.

Figure 4:
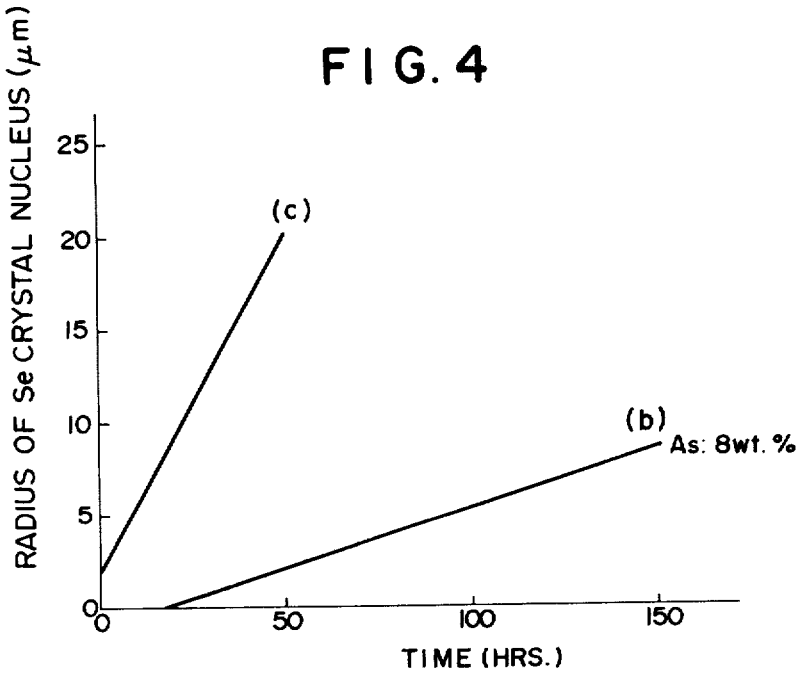
FIG. 4 is a graph showing the growth rate of a selenium crystal in the embodiment of a layered photoconductor according to the present invention and the growth rate of a selenium crystal in the conventional selenium photoconductor, each of which growth rate was determined by measuring the rate of the increase in the radius of each selenium crystal nucleus.

From FIG. 3 and FIG. 4, it can be seen that arsenic is capable of significantly hindering the crystallization of amorphous selenium.

The function of halogen, for instance, iodine or chlorine, contained in the photoconductor according to the present invention, will now be explained. Halogen serves to prevent the charging fatigue of the photoconductor, which will be caused by arsenic added to the photoconductor unless halogen is added thereto. The amount of halogen added to the photoconductor ranges from 10 to 500 ppm with respect to the total of selenium and tellurium. When the amount of halogen is less than 10 ppm, the charging fatigue prevention effect is insufficient for practical use, while when the amount of halogen exceeds 500 ppm, the resistivity of the photoconductor in the dark decreases, so that the charge retention property of the photoconductor is significantly degraded.

The thickness of the charge generating layer comprising the selenium-tellurium-arsenic-halogen alloy in the present invention ranges from 3 μm to 10 μm. When the charge generating layer is thinner than 3 μm, the layer does not function as a charge generating layer, while when the charge generating layer is thicker than 10 μm, the charge generating function of the layer is not improved any further with the increase in thickness. Therefore, it is unnecessary to make the charge generating layer thicker than 10 μm.

The following are examples of formulations of electrophotographic layered photoconductors according to the present invention, in which Example 1 is the aforementioned first embodiment of the present invention, and Example 2 is the second embodiment thereof.

Example 1

In a vacuum bell jar, with a vacuum of $1\times10^{-5}$ to $1\times10^{-6}$ torr. enclosed, an electrically conductive aluminum substrate (6 cm wide, 10 cm long and 0.5 mm thick) was placed over a selenium-tellurium-iodine alloy in a first evaporation source in the form of a boat made of tantalum. In the selenium-tellurium-iodine alloy in the first evaporation source, the concentration of tellurium was 6 weight percent of the total of selenium and tellurium and the concentration of iodine was equal to 500 ppm of the total of selenium and tellurium. The temperature of the aluminum substrate was maintained at 70° C., while the selenium-tellurium-iodine alloy in the first evaporation source was heated to 320° C. by causing 20 A current to flow through the tantalum boat. Evaporation was permitted to continue until a layer of selenium-tellurium alloy doped with iodine with a thickness of 50 μm was formed on the aluminum substrate. This vacuum evaporation required 30 minutes. Thus, a charge transporting layer was formed on the electrically conductive aluminum substrate.

The electrically conductive aluminum substrate with the charge transporting layer was subsequently placed over a selenium-tellurium-arsenic-iodine alloy in a second evaporation source in the form of a boat made of tantalum.

In the selenium-tellurium-arsenic-iodine alloy in the second evaporation source, the concentration of tellurium was 6 weight percent of the total of selenium and tellurium and the concentration of arsenic and that of iodine were respectively equal to 5 weight percent and 500 ppm of the total of selenium and tellurium.

The temperature of the aluminum substrate was continuously maintained at 70° C., while the selenium-tellurium-arsenic-iodine alloy was heated to 350° C. by causing a 20 A current to flow through the second tantalum boat. Evaporation was permitted to continue until a layer of selenium-tellurium-arsenic alloy doped with iodine with a thickness of 5 μm was formed on the first formed charge transporting layer, forming a charge generating layer. This vacuum evaporation required 5 minutes.

Thus, the first embodiment of a layered electrophotographic photoconductor according to the present invention was prepared.

Thereafter, with respect to the electrophotographic photoconductor prepared as described above, (1) spectral sensitivity, (2) surface potential, (3) surface hardness, (4) selenium crystallization and (5) photosensitivity were measured.

(1) Measurement of Spectral Sensitivity

The spectral sensitivity (Sλ) in coulomb/joule was measured in accordance with the following definition:

Spectral sensitivity of the electrophotographic photoconductor can be defined by the following equation:

$$S\lambda = \text{(the quantity of electric charges decreased by exposure)/(the quantity of exposure light)}$$

$$= \frac{C\,(400 - V') \times 10^2}{\eta \times I\lambda \times t \times (l/2\pi r)}$$

where

C = Capacitance (F/m²)

t = half-decay time (sec.) required for decreasing the initial surface potential of the photoconductor to ½ the initial surface potential by monochromatic light wherein the initial surface potential is 800 volts.

ΔV' = Decrease in the surface potential (volt) in the dark at the half-decay time t Iλ = Intensity of monochromatic light (μW/cm²)

η = Quantum efficiency l = Length (mm) of monochromatic light projected along the circumference of a drum around which a sample of the photoconductor is wound, which length is equal to the width of a slit for monochromatic light r = Radius (mm) of the drum A sample of the photoconductor was wound around a drum and monochromatic light with a length of l was projected upon the photoconductor and the above-mentioned half-decay time t was obtained. The dark decay value of the photoconductor at the time t was also obtained, so that ΔV' was determined. Since the values of the other factors in the above-mentioned equation are known, the spectral sensitivity Sλ was obtained. The results are shown by curve (a) in FIG. 2.

(2) Surface Potential

Corona charges of 10 μA were applied to a sample of the photoconductor in the dark. The thus obtained surface potential was 1,500 V.

(3) Surface Hardness

The surface hardness of a sample of the photoconductor was 90 in terms of Vicker's hardness under application of a load of 25 g thereto.

(4) Selenium Crystallization

A sample of the photoconductor was allowed to stand at 50° C. for 150 hours. No crystallization of amorphous selenium in the sample was observed.

(5) Photosensitivity

The photosensitivity of a sample of the photoconductor according to the present invention was measured as follows:

The sample was charged by corona charging until the surface potential of the sample increased to 1,000 volts and then white light was projected onto the sample until the surface potential of the sample decreased to 100 volts. The time T required for decreasing the surface potential from 1,000 volts to 100 volts was measured. The product of the energy of the projected light (μW/cm²) and the time T (seconds) is the photosensitivity (μJ/cm²) of the photoconductor.

Figure 5:
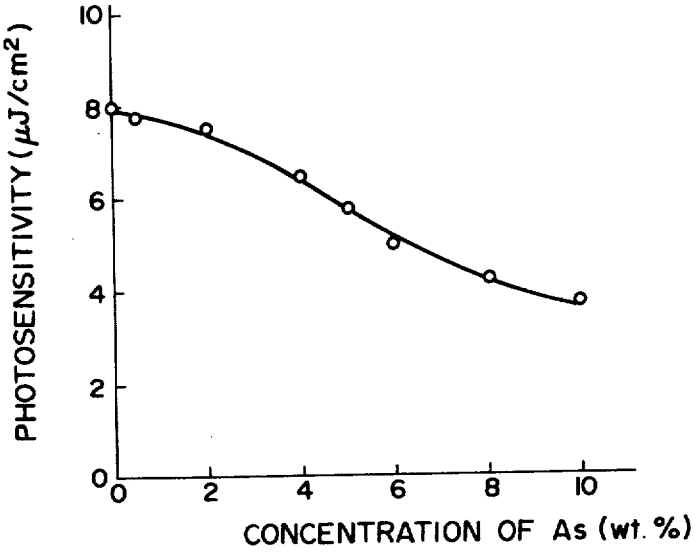
FIG. 5 is a graph showing the relationship between the photosensitivity of layered photoconductors according to the present invention and the concentration of arsenic in the photoconductor.

The photosensitivity of the first embodiment of a photoconductor according to the present invention which contains arsenic was 5.7 μJ/cm² (refer to FIG. 5).

Example 2

In a vacuum bell jar, with a vacuum of $1\times10^{-5}$ to $1\times10^{-6}$ torr. enclosed, an electrically conductive aluminum substrate (6 cm wide, 10 cm long and 0.5 mm thick) was placed over a selenium-tellurium-chlorine alloy in a first evaporation source in the form of a boat made of tantalum. In the selenium-tellurium-chlorine alloy in the first evaporation source, the concentration of tellurium was 8 weight percent of the total of selenium and tellurium and the concentration of chlorine was equal to 50 ppm of the total of selenium and tellurium. The temperature of the aluminum substrate was maintained at 70° C., while the selenium-tellurium-chlorine alloy in the first evaporation source was heated to 320° C. by causing 20 A current to flow through the tantalum boat. Evaporation was permitted to continue until a layer of selenium-tellurium alloy doped with chlorine with a thickness of 50 μm was formed on the aluminum substrate. This vacuum evaporation required 30 minutes. Thus, a charge transporting layer was formed on the electrically conductive aluminum substrate.

The electrically conductive aluminum substrate with the charge transporting layer was subsequently placed over a selenium-tellurium-arsenic-chlorine alloy in a second evaporation source in the form of a boat made of tantalum.

In the selenium-tellurium-arsenic-chlorine alloy in the second evaporation source, the concentration of tellurium was 6 weight percent of the total of selenium and tellurium and the concentration of arsenic and that of chlorine were respectively equal to 8 weight percent and 50 ppm of the total of selenium and tellurium.

The temperature of the aluminum substrate was continuously maintained at 70° C., while the selenium-tellurium-arsenic-chlorine alloy was heated to 350° C. by causing a 20 A current to flow through the second tantalum boat. Evaporation was permitted to continue until a layer of selenium-tellurium-arsenic alloy doped with chlorine with a thickness of 5 μm was formed on the first formed charge transporting layer, forming a charge generating layer. This vacuum evaporation required 5 minutes.

Thus, the second embodiment of a layered electrophotographic photoconductor according to the present invention was prepared.

Thereafter, with respect to the electrophotographic photoconductor prepared as described above, (1) spectral sensitivity, (2) surface potential, (3) surface hardness, (4) selenium crystallization and (5) photosensitivity were each measured in the same manner as in Example 1.

The results were as follows:

(1) Spectral Sensitivity Sλ

The spectral sensitivity Sλ is shown by curve (b) in FIG. 2.

(2) Surface Potential 1,400 volts.

(3) Surface Hardess 90 in terms Vicker's hardness under application of a load of 25 g thereto.

(4) Selenium Crystallization

A sample of the photoconductor was allowed to stand at 50° C. for 150 hours. No crystallization of amorphous selenium in the sample was observed.

(5) Photosensitivity

Referring to FIG. 5, there is shown the relationship between the photosensitivities of the photoconductors according to the present invention and the concentration of arsenic contained in each of the photoconductors, with the photosensitivity ($\mu J/cm^2$) as ordinate and the concentration of arsenic (weight percent) as abscissa.

As can be seen from the figure, the photosensitivity decreases as the concentration of arsenic in the photoconductor increases.

The embodiments described are intended to be merely exemplary and those skilled in the art will be able to make variations and modifications in them without departing from the spirit and scope of the invention. For instance, fluorine and bromine can be employed as halogen for use in the charge transporting layer and the charge generating layer of the photoconductors according to the present invention. All such modifications and variations are contemplated as falling within the scope of the claims.

What is claimed is:

1. A layered electrophotographic photoconductor comprising:

an electrically conductive base;

a charge transporting layer, with a thickness ranging from 45 μm to 55 μm, formed on said electrically conductive base, which charge transporting layer comprises a selenium-tellurium alloy, the concentration of tellurium ranging from 1 to 10 weight percent of the total of the selenium-tellurium, doped with halogen with a concentration equal to 10 to 500 ppm of the total of selenium and tellurium; and a charge generating layer, with a thickness ranging from 3 to 10 μm, formed on said charge transporting layer, which charge generating layer comprises a selenium-tellurium-arsenic alloy, doped with halogen, the concentration of tellurium ranging from 6 to 10 weight percent of the total of selenium and tellurium, the concentration of arsenic ranging 0.5 to 10 weight percent with respect to the total of selenium and tellurium, and the concentration of halogen ranging from 10 ppm to 500 ppm with respect to the total of selenium and tellurium.

2. A layered electrophotographic photoconductor as claimed in claim 1, wherein said halogen is selected from the group consisting of fluorine, chlorine, bromine and iodine.

3. A layered electrophotographic photoconductor comprising:

an electrically conductive base;

a charge transporting layer, with a thickness of 50 μm, formed on said electrically conductive base, the concentration of tellurium being 6 weight percent of the total selenium and tellurium, doped with iodine with a concentration equal to 500 ppm of the total of selenium and tellurium; and a charge generating layer, with a thickness of 5 μm, formed on said charge transporting layer, which charge generating layer comprises a selenium-tellurium-arsenic alloy, doped with iodine, the concentration of tellurium being 6 weight percent of the total of selenium and tellurium, the concentration of arsenic being 5 weight percent with respect to the total of selenium and tellurium, and the concentration of iodine being 500 ppm with respect to the total of selenium and tellurium.

4. A layered electrophotographic photoconductor comprising:

an electrically conductive base;

a charge transporting layer, with a thickness of 50 μm, formed on said electrically conductive base, the concentration of tellurium being 8 weight percent of the total of selenium and tellurium, doped with chlorine with a concentration equal to 50 ppm of the total of selenium and tellurium; and a charge generating layer, with a thickness of 5 μm, formed on said charge transporting layer, which charge generating layer comprises a selenium-tellurium-arsenic alloy, doped with chlorine, the concentration of tellurium being 6 weight percent of the total of selenium and tellurium, the concentration of arsenic being 8 weight percent with respect to the total of selenium and tellurium, and the concentration of chlorine being 50 ppm with respect to the total of selenium and tellurium.

* * * * *